US007493856B2

(12) United States Patent
Riedel

(10) Patent No.: US 7,493,856 B2
(45) Date of Patent: Feb. 24, 2009

(54) ROTOGRAVURE PRINTING UNITS

(75) Inventor: Uwe Johann Riedel, Dirmstein (DE)

(73) Assignee: Officine Meccaniche Giovanni Cerutti S.p.A., Casale Monferrato (IT)

( * ) Notice: Subject to any disclaimer, the term of this patent is extended or adjusted under 35 U.S.C. 154(b) by 289 days.

(21) Appl. No.: 10/575,101

(22) PCT Filed: Jul. 9, 2004

(86) PCT No.: PCT/EP2004/051441

§ 371 (c)(1),
(2), (4) Date: Apr. 10, 2006

(87) PCT Pub. No.: WO2005/035249

PCT Pub. Date: Apr. 21, 2005

(65) Prior Publication Data

US 2007/0051256 A1 Mar. 8, 2007

(30) Foreign Application Priority Data

Oct. 8, 2003 (DE) ..... 103 41 709

(51) Int. Cl.
*B41F 1/46* (2006.01)

(52) U.S. Cl. ..... 101/348; 101/351.6

(58) Field of Classification Search ..... 101/153, 101/208, 347, 350.1, 350.2, 350.3, 351.6, 101/352.06, 348, 35.5, 351.61
See application file for complete search history.

(56) References Cited

U.S. PATENT DOCUMENTS

| | | | | | |
|---|---|---|---|---|---|
| 1,259,394 | A | | 3/1918 | Gutberlet | |
| 4,620,481 | A | * | 11/1986 | Steiner | 101/350.3 |
| 5,046,417 | A | * | 9/1991 | Paulson | 101/148 |
| 5,454,311 | A | | 10/1995 | Reffert | |
| 5,497,700 | A | | 3/1996 | Herb | |
| 5,980,141 | A | * | 11/1999 | Donnis | 400/625 |
| 6,109,181 | A | * | 8/2000 | Kamoda | 101/477 |
| 6,283,023 | B1 | | 9/2001 | Christmann et al. | |
| 6,349,644 | B1 | | 2/2002 | Mohrmann et al. | |
| 6,354,700 | B1 | * | 3/2002 | Roth | 347/103 |
| 6,684,784 | B2 | * | 2/2004 | Kolbe et al. | 101/425 |
| 2006/0185541 | A1 | * | 8/2006 | Czeranka et al. | 101/376 |

FOREIGN PATENT DOCUMENTS

| | | | |
|---|---|---|---|
| CH | 012 232 | | 4/1896 |
| DE | 1 768 214 | | 6/1958 |
| DE | 1 230 437 | | 5/1960 |
| DE | 42 38 054 | C2 | 7/1996 |
| DE | 19828142 | A1 * | 12/1999 |
| DE | 199 12 313 | A1 | 9/2000 |
| EP | 0 655 328 | B1 | 9/1998 |
| EP | 0 980 311 | B1 | 11/2001 |

* cited by examiner

*Primary Examiner*—Daniel J Colilla
*Assistant Examiner*—David Banh
(74) *Attorney, Agent, or Firm*—Jones, Tullar & Cooper, PC

(57) ABSTRACT

A rotogravure printing unit includes a forme cylinder and an inker unit. The inker unit includes a trough which holds liquid or pasty ink. A first inking roller, which can rotate inside the trough, extends over a first width section of the trough and the forme cylinder. A second inking roller, which can also rotate inside the trough, extends over a second width section of the forme cylinder or the trough.

10 Claims, 8 Drawing Sheets

01

ROTOGRAVURE PRINTING UNITS

CROSS-REFERENCE TO RELATED APPLICATIONS

This patent application is the U.S. National Phase, under 35 USC 371, of PCT/EP2004/051441, filed Jul. 9, 2004; published as WO 2005/035249 A1 on Apr. 21, 2005 and claiming priority to DE 103 41 709.5, filed Oct. 8, 2003, the disclosures of which are expressly incorporated herein by reference.

FIELD OF THE INVENTION

The present invention is directed to rotogravure printing units. The printing units each have a rotogravure printing cylinder and an inking unit with at least three inking rollers.

BACKGROUND OF THE INVENTION

A printing forme, which, as a rule, is made of copper and which has engraved depressions, is attached to the shell face of a forme cylinder. These engraved depressions are filled with ink by an inking unit. In the course of printing, a paper web is pressed against the forme cylinder by a counter-pressure cylinder and absorbs the ink situated in the depressions. Before the printing forme inked by the inking unit, comes into contact with the paper, excess ink on the printing forme is removed by a doctor blade device, so that ink remains only in the depressions of the printing forme.

An inking unit for a rotogravure rotary printing press is known from EP 0 980 311 B1, and consists substantially of a doctor blade device, an ink trough and a catch basin. The ink trough, as well as the catch basin, of this inking unit can be adjusted in height.

An inking unit for a rotogravure rotary printing press is also known from EP 0 655 328 B1. This unit has an ink trough for receiving ink, an inking roller and a doctor blade device which is acting on the shell face of the forme cylinder. The ink trough of this inking unit is arranged underneath the forme cylinder, and under the inking roller which dips into the ink. A width of the ink trough is furthermore less than a width of the forme cylinder.

Paper webs of greater width are increasingly frequently being processed. Longer forme cylinders, with widths between 1.5 m to 4.5 m, are required for this. In conventional inking units, such wide forme cylinders are inked by the use of appropriately wide inking rollers. However, at such widths, the forme cylinders, as well as the inking rollers, have an increased tendency to sag. In this case, they sag more as their diameter is reduced. In connection with conventional rotogravure rotary printing presses, for use in processing paper webs of great width, it therefore occurs that ink fluctuations up to a complete loss of ink, appear in the finished product. This is because the inking roller rests unevenly against the forme cylinder and the latter is therefore inked, in different degrees, in different areas.

Gaps can even occur between the inking roller and the forme cylinder, so that portions of the printing forme, which is supported by the forme cylinder, are not inked at all. For example, such a gap between the two cylinders occurs in a center area of the cylinder width, if the forme cylinder has a large diameter and the inking roller has a small diameter, so that the inking roller sags more in its center than does the forme cylinder. In connection with a thin forme cylinder, it can happen that the thin forme cylinder sags more than the inking roller. A gap between the forme cylinder and the inking roller is thereby formed in edge areas of the forme cylinder, and the printing forme is not inked there.

DE 42 38 054 C2 discloses an inking unit for a rotogravure forme cylinder. The inking unit includes a single continuous inking roller and an additional shorter support roller.

CH 012 232, U.S. Pat. No. 1,259,394 and DE 17 58 214 U all show inking rollers which are divided in an axial direction of the roller. These divisions are arranged on a common shaft.

In DE 1 230 437 B, there is shown a device in which several inking rollers are placed against a forme cylinder for steel engraving, each of which inking roller transports a separate colored ink. There is no discussion regarding their lengths.

SUMMARY OF THE INVENTION

The object of the present invention is directed to providing a rotogravure printing unit.

The object is attained, in accordance with the present invention, by the provision of a rotogravure printing unit which has a rotogravure printing cylinder and an inking unit. The inking unit includes at least three inking rollers which can be placed against the forme cylinder. Each of these inking rollers can be moved, with respect to the forme cylinder, independently of the other inking rollers. At least one of these inking rollers may overlap the other two rollers in an axial direction of the rollers and the printing cylinder.

The advantages which can be achieved by the invention reside, in particular, in that such an inking unit allows even inking, even of wide forme cylinders, because several inking rollers are provided, and because of which, individual inking rollers can be employed for inking problematical areas of the forme cylinder. A single inking roller does not need to extend over the entire width of the surface of the forme cylinder to be inked. Instead, the width of the individual inking roller will preferably be limited to a surface area of the forme cylinder which can be inked without problems. Adjoining surface areas of the forme cylinder will each be assigned their own inking roller. With such an inking unit, the several short inking rollers can all be brought into contact with the forme cylinder, each over their entire width.

The inking rollers can be arranged so that they are staggered in the inking unit. Staggering of the inking rollers can take place over the forme cylinder width, as well as over a length of the trough.

In this case, preferably at least two inking rollers are arranged along the same shaft.

The inking unit can be embodied in such a way that two areas of width, along which an inking roller extends, overlap.

In a particularly preferred embodiment of the present invention, the inking rollers dip, at least partially, into the ink in the ink trough. In this case, the inking rollers can transfer ink from the trough directly to the forme cylinder without interposed roller systems needing to be provided.

Also, in a particularly preferred embodiment, the inking rollers can each be separately height-adjusted within the trough. This permits the individual adjustment of each of the inking rollers to accommodate for sagging of the forme cylinder and to let all of the inking rollers act against the forme cylinder with the same contact force. A uniform inking of the printing forme thus results.

To assure the ink transfer to the printing forme, and particularly into the depressions of the printing forme, the inking rollers are preferably provided with a terrycloth-like covering, or with a visco-elastic covering.

The printing unit has several inking rollers, which can be placed against different parts of the width of a forme cylinder.

Preferably, the inking rollers are a part of an inking unit as described above. However, it is also possible to assign each inking roller its own ink trough.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
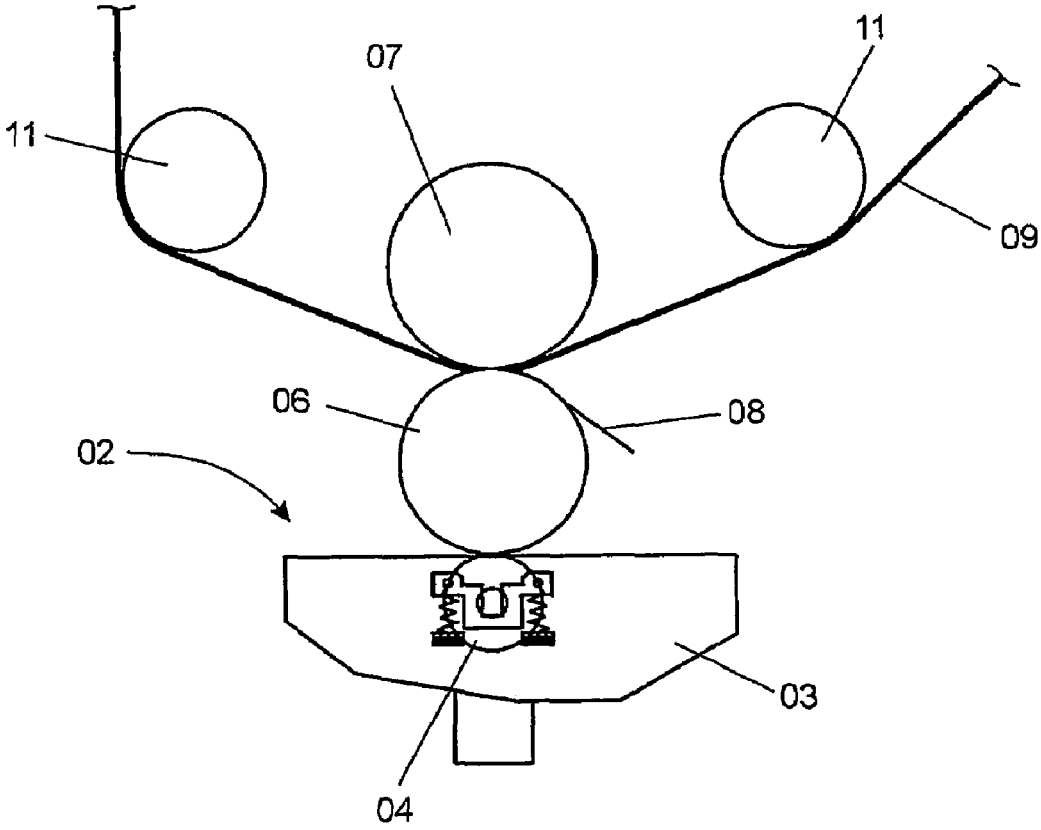
FIG. 1, a schematic side elevation view through a printing unit of a generally conventional rotogravure rotary printing press, in FIG. 2, a front elevation view of a typical printing unit with a forme cylinder of a large diameter, in FIG. 3, a front elevation view of a typical printing unit with a forme cylinder of a small diameter, in FIG. 4, a first embodiment of an inking unit in accordance with the present invention, in FIG. 5, a second embodiment of an inking unit in accordance with the present invention, in FIG. 6, a third embodiment of an inking unit in accordance with the present invention, in FIG. 7, a cross section through a printing unit of a rotor-gravure rotary printing press with an inking unit, in FIG. 8, a front elevation view of a portion of a printing unit with an inking unit and a forme cylinder of a large diameter, and in FIG. 9, a front elevation view of a portion of a printing unit with an inking unit and a forme cylinder of a small diameter.

A side elevation view, partly in cross-section, of a generally conventional rotogravure gravure printing unit 01 of a rotogravure rotary printing press can be seen in FIG. 1. Printing unit 01 consists of an inking unit 02, a cylinder 06, for example a forme cylinder 06, a cylinder 07, for example a counter-pressure cylinder 07, a doctor blade 08, as well as guide cylinders 11. The forme cylinder 06 has a printing forme on its outer shell face, which printing forme, which is not specifically depicted, has engraved depressions. Forme cylinder 06 is rotatably seated in a frame, which is not specifically represented. The inking unit 02 has been placed against the forme cylinder 06 from below. The doctor blade 08 has been placed against the forme cylinder 06 from the side of the forme cylinder 06. The counter-pressure cylinder 07 presses, from above, against the forme cylinder 06, and together with it defines a printing gap. A web 09 of material to be imprinted by the printing unit 01, such as, for example, a paper web 09, is conducted through this printing gap. Prior to entering the printing gap, or after leaving the printing gap, the paper web 09 loops around respective ones of the guide cylinders 11, all as seen in FIG. 1.

The inking unit 02 is comprised of a trough 03 and an inking roller 04. A liquid or a pasty ink has been introduced into the trough 03. The inking roller 04 is rotatably seated inside the trough 03 and dips partially into the ink. Inking roller 04 is provided with a fibrous terrycloth-like or visco-elastic covering on its surface. The inking unit 02, as a whole, can be displaced in height relative to the forme cylinder 06. In the position of the inking unit 02, which is represented in FIG. 1, the inking roller 04 has been placed against the shell surface or against the printing forme carried on the forme cylinder 06.

The forme cylinder 06 is rotating during the operation of the printing unit 01. Because of its positive contact with the forme cylinder 06, the inking roller 04 can also be rotatingly taken along by the forme cylinder 06. However, the inking roller 04 can also be rotatingly driven independently of the forme cylinder 06, and at a circumferential speed which may differ from the circumferential speed of the forme cylinder 06. This is done in order to distribute the ink on the surface of the inking roller 04. Because the inking roller 04 dips into the ink received in the trough 03, and as a result of its rotating movement, the inking roller 04 transfers this ink from the trough to the surface of the forme cylinder 06. More correctly, the ink is transferred to the printing forme which is applied to the shell face of the forme cylinder 06. This ink transferal effect is furthered by the particularly absorbent nature of the cover of the inking roller 04. Because of the fibrous or elastic embodiment of the inking roller cover, it is possible to introduce the ink into the depressions of the printing forme.

In the course of further rotation of the forme cylinder 06, excess ink that is remaining on the printing forme, and which has not been reached the depressions, is removed by the doctor blade 08. The result is that only the ink in the depressions is left on the printing forme. This ink is absorbed out of the depressions in the printing forme by the paper web 09, which paper web 09 is pressed against the forme cylinder 06 by the counter-pressure cylinder 07, as the web 09 makes its way through the printing gap.

Figure 2:
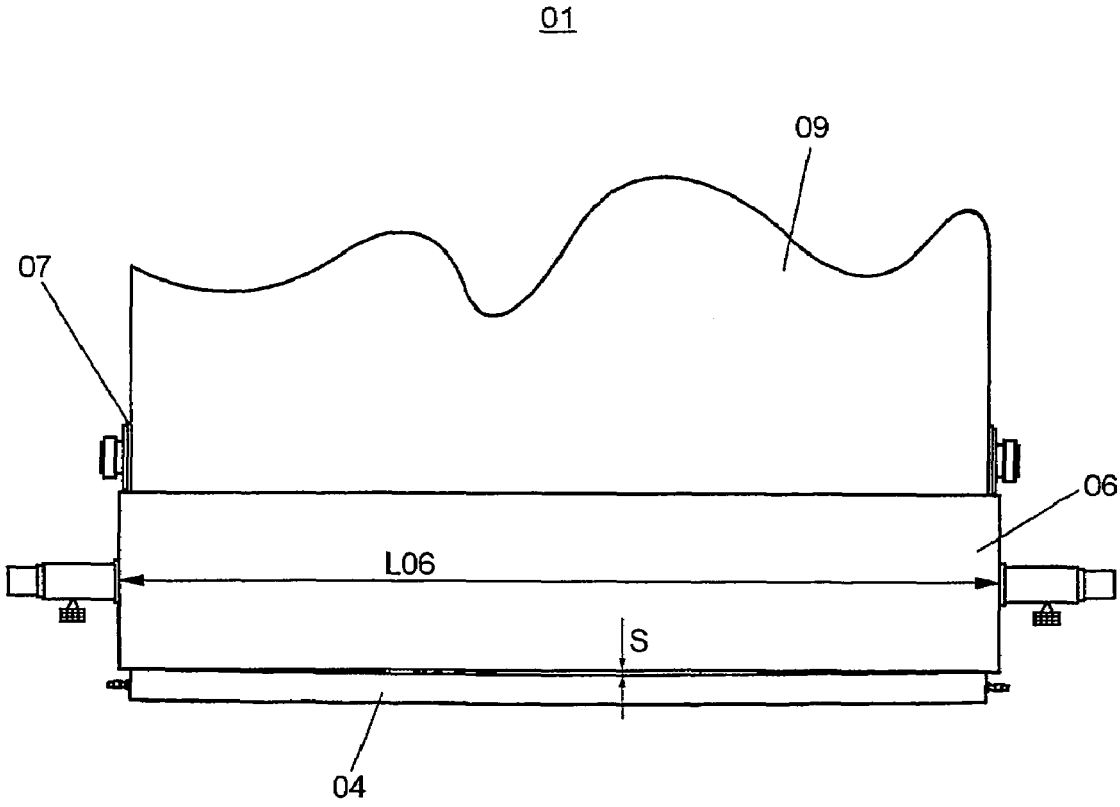
Figure 3:
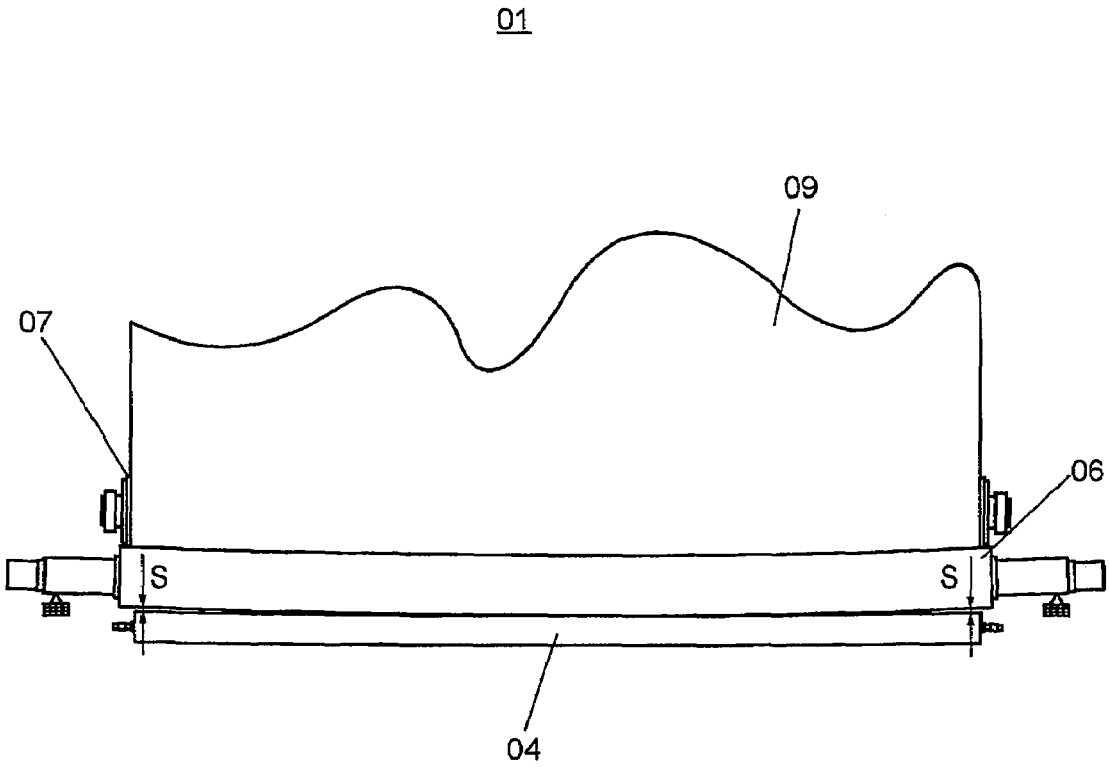

FIGS. 2 and 3 illustrate the problems which are apt to occur, if wide forme cylinders 06 are used in printing units 01 of the type described above, when it is intended to imprint a paper web 09 of 150 cm width or more.

FIG. 2 shows the situation in the context of a printing unit 01 with a forme cylinder 06 of large diameter. A front view of a portion of the printing unit 01 can be seen in FIG. 2, and specifically the forme cylinder 04 with the inking roller 06 of the inking unit 02 placed against it. Only the ends of the counter-pressure cylinder 07 are visible, since the counter-pressure cylinder 07 is covered, to a large extent, by the paper web 09, which is entering the printing gap formed by the counter-pressure cylinder 07 and the forme cylinder 06.

As FIG. 2 shows, the inking roller 04 sags downwardly, particularly at its center. Although this is also the case with the forme cylinder 06, its sagging is substantially less than that experienced by the inking roller 04, because the forme cylinder 06 has a substantially larger diameter, and therefore has greater rigidity. As a result of the sagging of the inking roller 04, a gap S is formed between the inking roller 04 and the forme cylinder 06 and is located in the center of the inking roller 04. The inking roller 04 does not come into contact with the forme cylinder 06 in the area of the gap S. As a result of this lack of contact, there is also no inking in this area of the printing forme which is applied to the forme cylinder 06. Un-inked spots in the finished product are the result of this gap S.

FIG. 3 shows a similar situation in the situation of a printing unit 01 with a forme cylinder 06, which forme cylinder 06 has a small diameter. Based on its inherent weight, and because of the weight of the counter-pressure cylinder 07 which is pushing against it, the forme cylinder 06 sags substantially more than the inking roller 04. In this case, gaps S are formed between the inking roller 04 and the forme cylinder 06 in their respective edge areas, while the inking roller 04 is in contact with the forme cylinder 06 at the center areas of each of the two rollers. In the configuration which is represented in FIG. 3, the edge areas of the printing forme, which is applied to the forme cylinder 06, are not being inked. In this configuration, un-inked spots result in the finished product in these edge areas.

Figure 4:
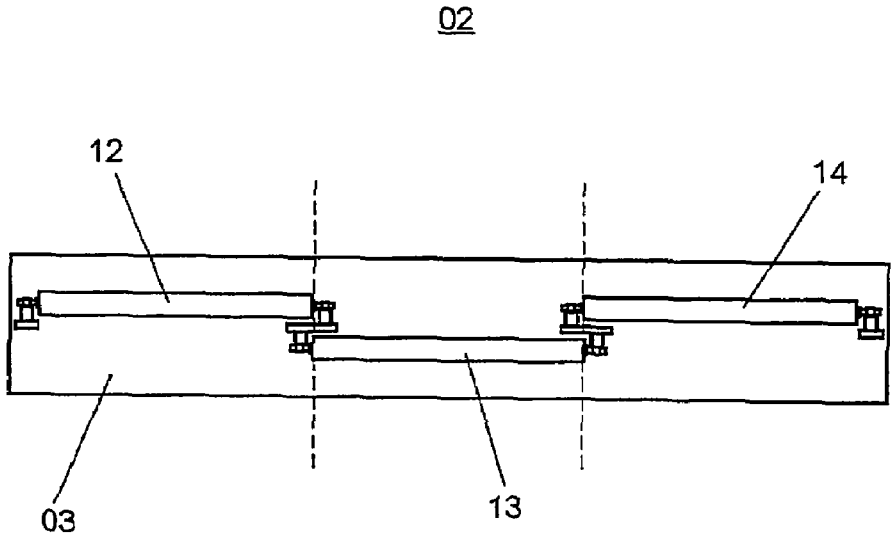

An inking unit 02, in accordance with the present invention, in which such gaps S can be prevented, when the inking unit 02 is used in a printing unit 01, is shown in FIG. 4.

FIG. 4 is a top plan view of an embodiment of an inking unit 02 in accordance with the present invention. FIG. 4 shows a trough 03, as well as three inking rollers 12, 13, 14, which are rotatably seated inside the trough 03. Each one of the inking rollers 12, 13, 14 extends over only a limited portion of the width of the trough 03. In this case, the inking rollers 12, 13, 14 are arranged staggered across the width of the trough 03, as well as along the length of the trough 03. The staggering of the inking rollers 12, 13, 14 across the width of the trough 03 is such that it takes place from the left to the right with increasing reference numerals, while staggering along the length of the trough 03 is such that the inking rollers 12 and 14 are arranged on and are rotatable around one shaft, which one shaft is offset parallel to, and in relation to a shaft around which the other inking roller 13 rotates.

All three of the inking rollers 12, 13, 14 depicted in FIG. 4 are arranged inside the trough 03 in such a way that the respective sections of width, along which each one of the inking rollers 12, 13 or 14 respectively extends, touch each other, free of overlap, at the planes defined by the dashed lines. In an alternative embodiment of the inking unit 02, the three sections of width can also overlap each other.

Figure 6:
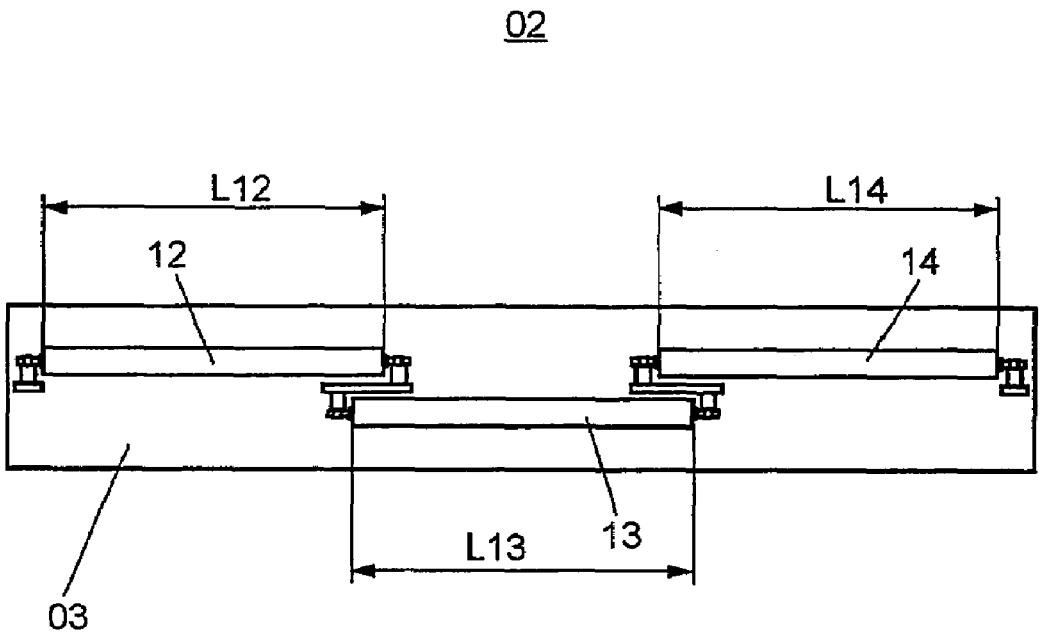

As may be seen in FIG. 6, an area of the rotogravure forme cylinder 06, which is inked by the first inking roller 13, and at least two of the areas of the rotogravure forme cylinder, which are inked by the at least two other inking rollers 12, 14 overlap, in this alternative embodiment, in the axial direction.

Each one of the at least three inking rollers 12, 13, 14 is preferably individually shorter than is the overall barrel of the rotogravure forme cylinder 06.

A length of the barrels L12, L13, L14 of each one of the inking rollers 12, 13, 14 is, for example, shorter than 1.1-times the length L06 of the barrel of the rotogravure forme cylinder 06 divided by the number N of the inking rollers 12, 13, 14 in the axial direction, i.e., for example, $$L12,\ L13,\ L14 = \frac{1.1 \times L06}{N}$$

wherein N=a whole number larger than, or equal to 3 N≧3.

Figure 5:
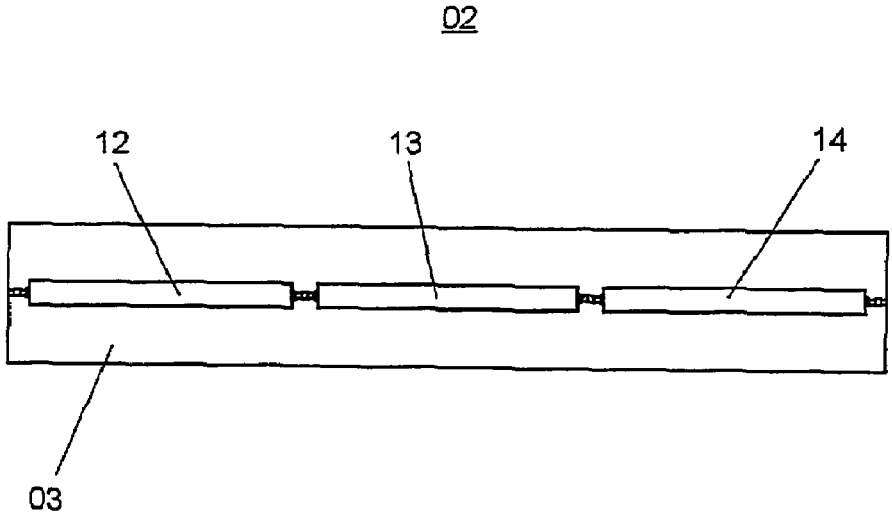

Another embodiment of an inking unit is represented in FIG. 5. In this embodiment, the inking unit 02 is again represented in a top plan view. Three inking rollers 12, 13, 14 can again be seen and are rotatably arranged inside a trough 03. In contrast to the previously represented case, which is shown in FIGS. 4 and 6, in the embodiment shown in FIG. 5, the three inking rollers 12, 13, 14 are all arranged along the same shaft. Now the areas of width along which each of the three inking rollers 12, 13, 14 extend, are spaced apart from each other.

Such an inking unit is well suited for use in a printing unit that is intended for printing several pages, side-by-side, on the paper web 09. These several pages are always separated from each other by a zone which is free of printing. If the width, and the number of the inking rollers 12, 13, 14 is selected to correspond to the width and to the number of pages to be printed side-by-side, the areas of the forme cylinder 06 which are not inked coincide with the non-printed zones of the paper web 09.

Figure 7:
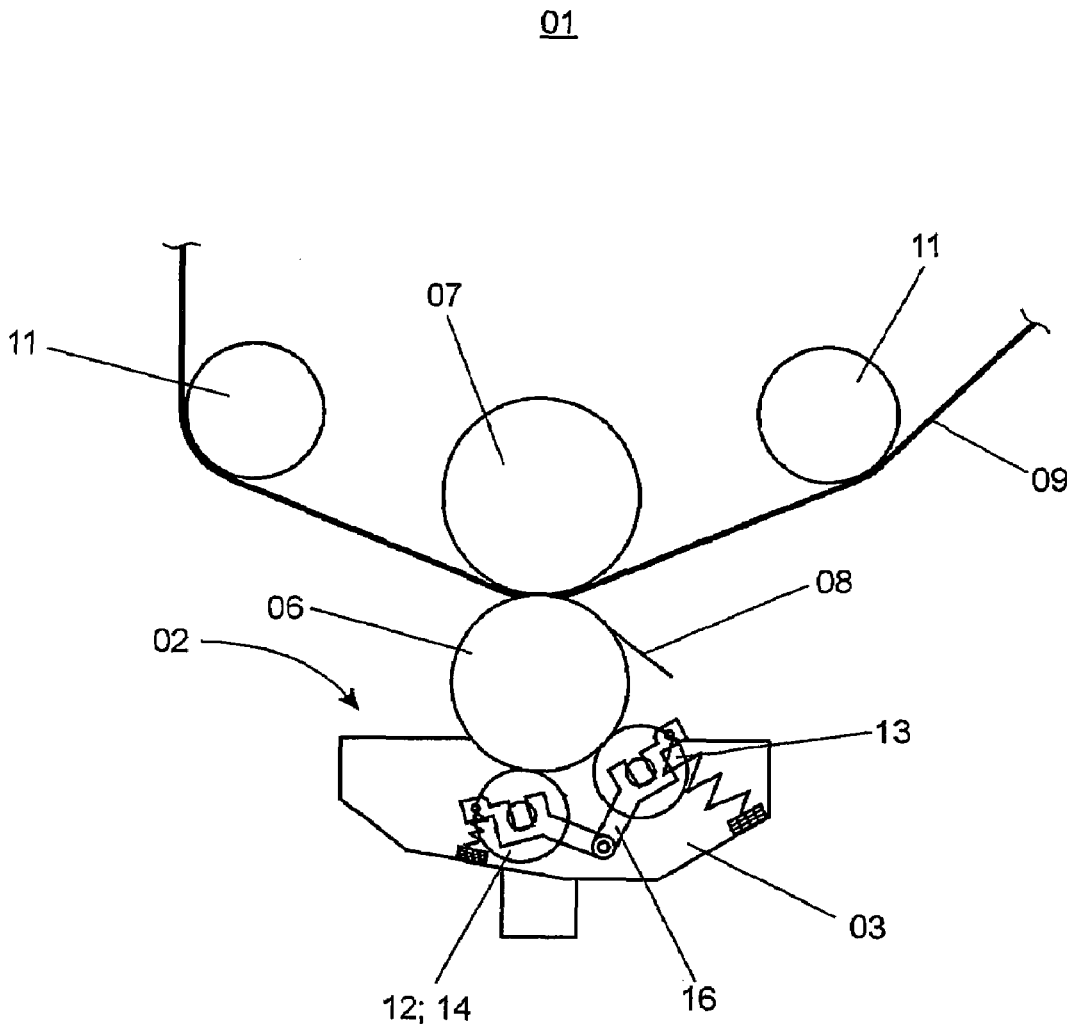
Figure 8:
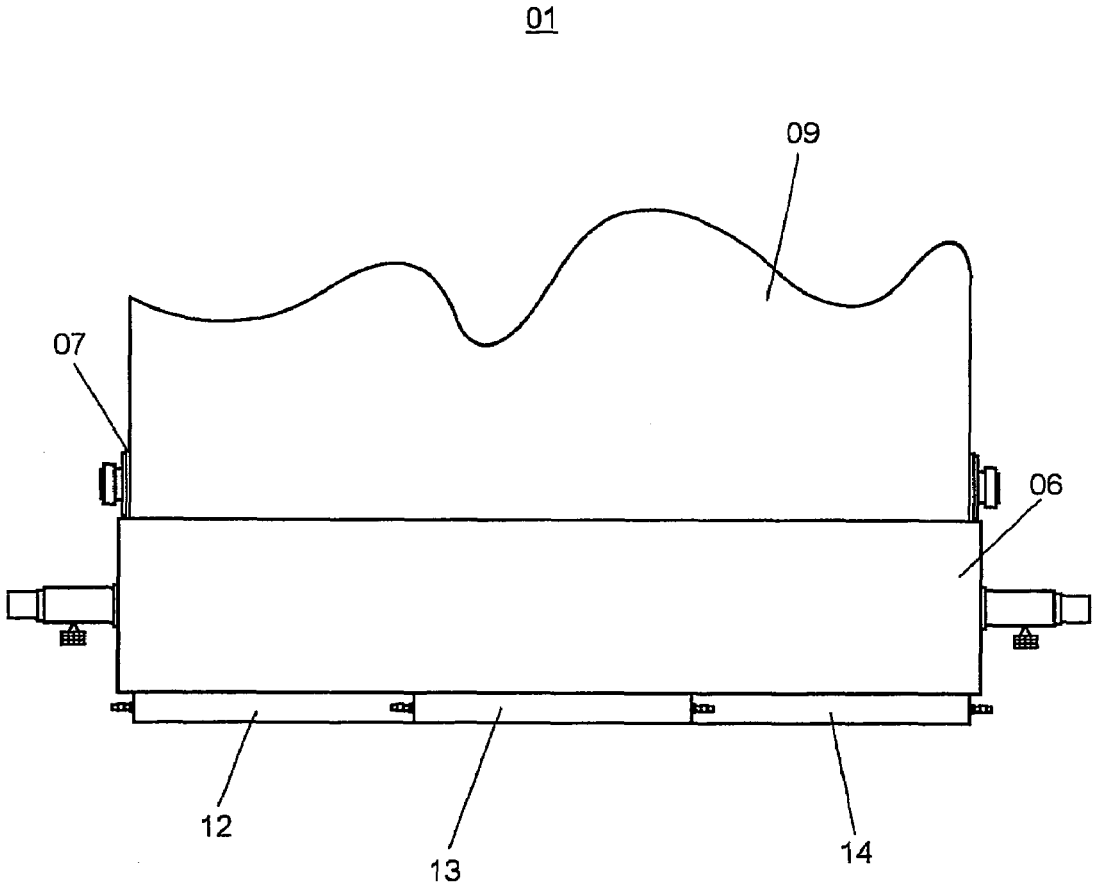

FIG. 7 shows, in a cross-sectional view, the operation of the inking unit 02, which is represented in FIG. 4, in a printing unit 01. Holding assemblies 16 can be seen in this cross section, by the use of which holding assemblies 16, the inking rollers 12, 13, 14 are held inside the trough 03. The inking rollers 12, 13, 14 can be adjusted, in height, within the trough 03. All three of the inking rollers 12, 13, 14 rest directly against the forme cylinder 06. It is possible, by manipulation of the holding assemblies 16, to set a contact force, with which individual ones of the several inking rollers 12, 13, 14 press against the forme cylinder 06. The inking rollers 12, 13, 14 can be matched to the bending of the forme cylinder 06 by this manipulation or adjustment of the holding assemblies 16. This is represented in FIG. 8, in which the parts of the printing unit 01, that are also represented in FIG. 7, can be seen in a front view. Now all three inking rollers 12, 13, 14 rest flush against the forme cylinder 06 because of the individual adjustment of the contact force of each inking roller 12, 13, 14. No gap S is present between the forme cylinder 06 and one of the inking rollers 12, 13, 14 at any point along the width of the forme cylinder 06. Thus, the printing forme, which is applied to the shell face of the forme cylinder 06, is evenly inked over the entire width of the forme cylinder 06.

Figure 9:
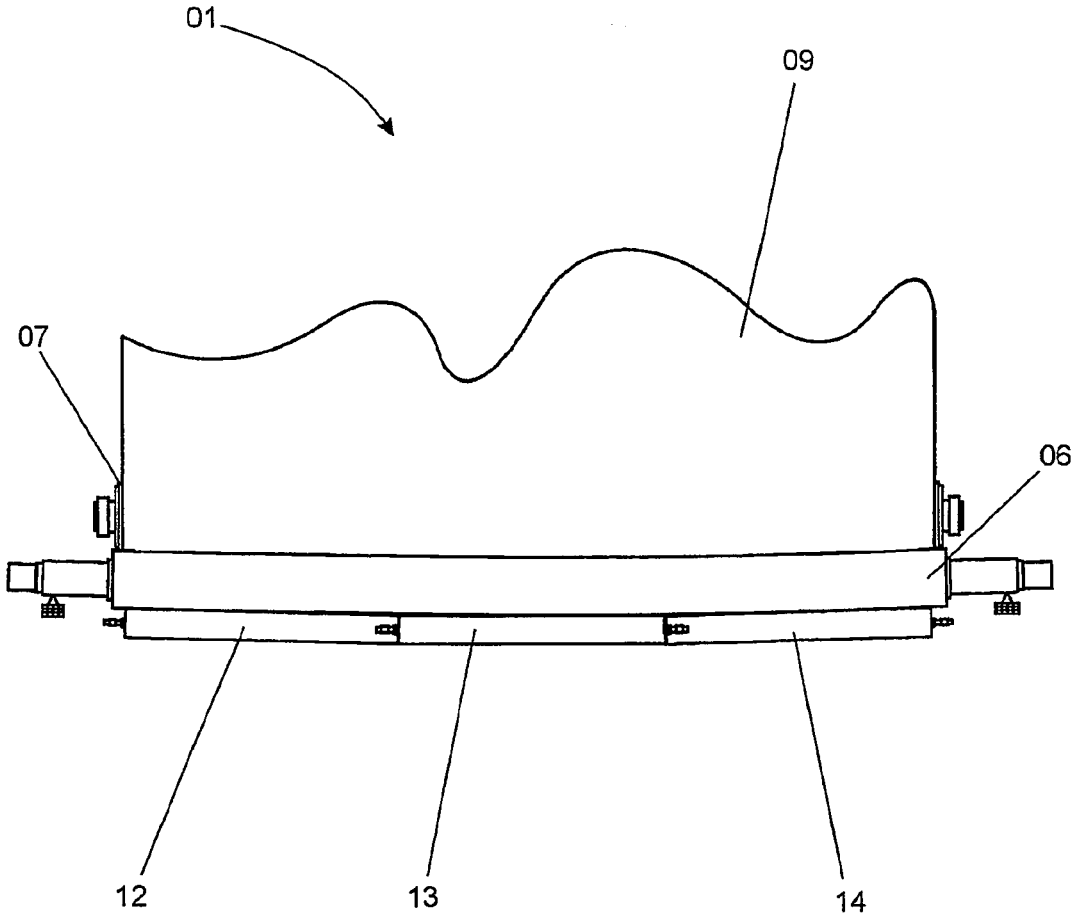

This has been shown, in a corresponding manner, in FIG. 9 for the situation of a forme cylinder 06 of a lesser diameter. Here, too, the inking rollers 12, 13, 14 rest flush against the forme cylinder 06. No gaps S appear between the forme cylinder 06 and the inking rollers 12 and 14 in the edge areas of the forme cylinder 06, since, in these edge areas, the inking rollers 12 and 14 are pressed against the forme cylinder 06 with the same contact pressure as the inking roller 13, because they have been appropriately height-adjusted inside the trough 03.

While preferred embodiments of rotogravure printing units in accordance with the present invention have been set forth fully and completely herinabove, it will be apparent to one of skill in the art that various changes in, for example, the drives for the forme cylinder and the counter-pressure cylinder, the type of web being printed, and the like could be made without departing from the true spirit and scope of the present invention which is accordingly to be limited only by the appended claims.

What is claimed is:

1. A rotogravure printing unit comprising:

a rotogravure printing cylinder having a printing cylinder barrel with a printing cylinder barrel surface having a printing cylinder barrel length;

an inking unit cooperating with said printing cylinder;

at least three inking rollers in said inking unit ,each one of said inking rollers having a roller barrel with a roller barrel surface and a roller barrel length, said roller barrel length of each of said at least three inking rollers being less than said printing cylinder barrel length, said at least three inking rollers being staggered in said inking unit with respect to said printing cylinder, and each said roller barrel surface being directly engageable with said printing cylinder barrel surface;

holding assemblies supporting each of said at least three staggered inking rollers in said inking unit for independent movement relative to said printing cylinder; and a common ink trough in said inking unit, each of said at least three staggered inking rollers dipping into said common inking trough and directly applying ink from said ink trough to said printing cylinder barrel surface, each of said at least three staggered inking rollers being separately height adjustable in said common ink trough.

2. The rotogravure printing unit of claim 1 wherein at least one of said at least three staggered inking rollers overlaps the others of said at least three inking rollers in an axial direction of said printing cylinder.

3. The rotogravure printing unit of claim 1 wherein areas of said printing cylinder barrel surface inked by said at least three staggered inking rollers overlap in said axial direction of said printing cylinder.

4. The rotogravure printing unit of claim 1 wherein a height of said printing unit with respect to said rotogravure printing cylinder is adjustable.

5. The rotogravure printing unit of claim 1 further including a counter-pressure cylinder adapted to engage said printing cylinder and to define a printing gap with said printing cylinder.

6. The rotogravure printing unit of claim 1 wherein at least two of said at least three staggered inking rollers are offset from each other in a circumferential direction of said printing cylinders.

7. The rotogravure printing unit of claim 1 wherein each of said at least three staggered inking rollers has a width, each said roller width being non-overlapping with each said other roller width.

8. The rotogravure printing unit of claim 7 wherein said widths of at least two of said at least three staggered inking rollers are spaced apart.

9. The rotogravure printing unit of claim 1 further including one of a terry cloth and visco-elastic covering for each of said at least three staggered inking rollers.

10. The rotogravure printing unit of claim 1, wherein L12, L13 and L14 are said roller barrel lengths of said at least three staggered inking roller barrels;

wherein L06 is said. printing cylinder barrel length;

wherein N is a whole number equal to, or greater than 3; and wherein $$L12,\ L13,\ L14 = \frac{1.1 \times L06}{N}.$$

* * * * *